US010089845B2

(12) United States Patent
Skorpik et al.

(10) Patent No.: US 10,089,845 B2
(45) Date of Patent: Oct. 2, 2018

(54) SYSTEM AND METHOD OF DETECTING AND ANALYZING A THREAT IN A CONFINED ENVIRONMENT

(71) Applicant: Battelle Memorial Institute, Richland, WA (US)

(72) Inventors: James R. Skorpik, Kennewick, WA (US); Michael S. Hughes, Richland, WA (US); Eric G. Gonzalez, Richland, WA (US)

(73) Assignee: Battelle Memorial Institute, Richland, WA (US)

( * ) Notice: Subject to any disclaimer, the term of this patent is extended or adjusted under 35 U.S.C. 154(b) by 397 days.

(21) Appl. No.: 14/639,647

(22) Filed: Mar. 5, 2015

(65) Prior Publication Data

US 2016/0260307 A1 Sep. 8, 2016

(51) Int. Cl.

| | |
|---|---|
| ***G08B 21/00*** | (2006.01) |
| ***G08B 21/02*** | (2006.01) |
| ***G08B 13/16*** | (2006.01) |

(52) U.S. Cl.

CPC ..... *G08B 21/02* (2013.01); *G08B 13/1672* (2013.01)

(58) Field of Classification Search

CPC .... G08B 13/00; G08B 13/16; G08B 13/1672; G08B 17/00; G08B 19/005; G08B 21/02

See application file for complete search history.

(56) References Cited

U.S. PATENT DOCUMENTS

| | | | | |
|---|---|---|---|---|
| 5,455,868 | A * | 10/1995 | Sergent | G08B 13/1672 367/906 |
| 5,917,775 | A * | 6/1999 | Salisbury | G01H 3/12 340/531 |
| 6,847,587 | B2 | 1/2005 | Patterson et al. | |
| 7,401,519 | B2 * | 7/2008 | Kardous | G01H 3/06 381/56 |
| 7,961,550 | B2 | 6/2011 | Calhoun | |
| 8,511,145 | B1 | 8/2013 | Desai et al. | |
| 2003/0021188 | A1 * | 1/2003 | Baranek | G08B 7/066 367/136 |
| 2009/0112525 | A1 * | 4/2009 | Adani | G06Q 10/04 702/189 |
| 2013/0202120 | A1 * | 8/2013 | Bickel | G08B 13/1672 381/56 |

(Continued)

FOREIGN PATENT DOCUMENTS

WO 2014134217 A1 9/2014

OTHER PUBLICATIONS

Lathi, B.P.; "Modern Digital and Analog Comunication Systems"; 1998; Oxford University Press; 3rd Edition; pp. 14-20.*

(Continued)

*Primary Examiner* — Ryan Sherwin
(74) *Attorney, Agent, or Firm* — Wells St. John P.S.

(57) ABSTRACT

A system and method of detecting and analyzing a threat in a confined environment is disclosed. An audio board detects and analyzes audio signals. A RF board transmits the signals for emergency response. A battery provides power to the audio board and the RF board. The audio board includes a microcontroller with at least one band-pass filter for distinguishing between a threat and a non-threat event and for measuring or counting pulses if the event is a threat.

21 Claims, 10 Drawing Sheets

(56) References Cited

U.S. PATENT DOCUMENTS

| | | | | |
|---|---|---|---|---|
| 2014/0361886 | A1* | 12/2014 | Cowdry | G08B 13/1672 340/522 |
| 2015/0070166 | A1* | 3/2015 | Boyden | G08B 25/08 340/540 |
| 2015/0371638 | A1* | 12/2015 | Ma | G10L 15/065 704/275 |
| 2016/0232774 | A1 | 8/2016 | Noland et al. | |
| 2017/0169686 | A1 | 6/2017 | Skorpik et al. | |

OTHER PUBLICATIONS

Wallace, Kirk et al.; "Sensitive Ultrasonic Delineation of Steroid Treatment in Living Dystrophic Mice with Energy-Based and Entropy-Based Radio Frequency Signal Processing"; Nov. 2007; IEEE; vol. 54, No. 11; pp. 2291-2299.*

Hughes, Michael et al.; "Use of Smoothing Splines for Analysis of Backscattered Ultrasonic Waveforms: Application to Monitoring of Steroid Treatment of Dystrphic Mice"; Nov. 2011; IEEE; vol. 58, No. 11; pp. 2361-2369.*

Hughes, Michael et al.; "Entropy vs. Energy Waveform Processing: A Comparison Based on the Heat Equation"; May 25, 2015; MDPI; Entropy Open Access Journal—vol. 17; pp. 3518-3551.*

Chacon-Rodriguez, A., et al., Evaluation of Gunshot Detection Algorithms, IEEE Transactions on Circuits and Systems—I: Regular Papers vol. 58, No. 2, 2011, 363-372.

Duckworth, G. L., et al., Acoustic counter-sniper system, SPIE International Symposium on Enabling Technologies for Law Enforcement and Security, 2938, 1996, 262-275.

Khan, S., et al., Weapon Identification Using Hierarchical Classification of Acoustic Signatures, Proc. of SPIE, vol. 7305, 1-5.

Maher, R. C., Modeling and Signal Processing of Acoustic Gunshot Recordings, Proc. 2nd Signal Process. Educ. Workshop, 4th Digital Signal Process. Workshop, 2006, 257-261.

Sadler, B. M., et al., Optimal and Robust Shockwave Detection and Estimation, 1997 IEEE International Conference on Acoustics, Speech, and Signal Processing, 1997, ICASSP-97, 1997, 1889-1892.

Stoughton, R., Measurements of small-caliber ballistic shop waves in air, Journal of the Acoustical Society of America, 102, 2, 1997, 781-787.

Weissler, P. G., et al., Noise of Police Firearms, Journal of the Acoustical Society of America, 1974, 56, 5, 1515-1522.

Khalid et al., "Gunshot Detection and Localization using Sensor Networks", Proceedings of the IEEE International Conference on Smart Instrumentation, Measurement and Applications (ICSIMA), Nov. 26-27, 2013, Kuala Lumpur, Malasia, 6 pages.

Luzi et al., "Acoustic Firearm Discharge Detection and Classification in an Enclosed Environment", The Journal of the Acoustical Society of America vol. 139, No. 5, May 2016, United States, pp. 2723-2731.

Maher, "Acoustical Characterization of Gunshots", IEEE Department of Electrical and Computer Engineering, Montana State University, 2007, United States, 5 pages.

Sinha et al., "Sniper Localization Using Passive Acoustic Measurements Over an Ad-Hoc Sensor Array", IEEE Department of Electrical and Computer Engineering, Indian Institute of Technology, 2015, Kanpur, India, 6 pages.

Hughes et al., "Additional Results for 'Joint Entropy of Continuously Differentiable Ultrasonic Waveforms' [J. Acoust. Soc. Am. 133(1), 283-300 (2013)] (L)", Journal of the Acoustical Society of America vol. 137, No. 1, Jan. 2015; United States, p. 501.

Hughes et al., "Application of Renyi Entropy for Ultrasonic Molecular Imaging", Journal of the Acoustical Society of America vol. 125, No. 5, May 2009, United States, pp. 3141-3145.

Hughes et al., "Characterization of Digital Waveforms using Thermodynamic Analogs: Applications to Detection of Materials Defects", IEEE Transactions on Ultrasonics, Ferroelectrics, and Frequency Control vol. 52, No. 9, Sep. 2005, United States, pp. 1555-1564.

Hughes et al., "Characterization of Digital Waveforms using Thermodynamic Analogs: Detection of Contrast-Targeted Tissue in Vivo", IEEE Transactions on Ultrasonics, Ferroelectrics, and Frequency Control vol. 53, No. 9, Sep. 2006, United States, pp. 1609-1616.

Hughes et al., "High Contrast Ultrasonic Imaging of Resin-Rich Regions in Graphite/Epoxy Composites using Entropy", AIP Conference Proceedings 1706, 2016, United States, 7 pages.

Hughes et al., "Improved Signal Processing to Detect Cancer by Ultrasonic Molecular Imaging of Targeted Nanoparticles", Journal of the Acoustical Society of America, vol. 129, No. 6, Jun. 2011, United States, pp. 3756-3767.

Hughes et al., "Joint Entropy of Continuously Differentiable Ultrasonic Waveforms", Journal of the Acoustical Society of America, vol. 133, No. 1, Jan. 2013, United States, pp. 283-300.

Hughes et al., "Properties of an Entropy-Based Signal Receiver with an Application to Ultraconic Molecular Imaging", Journal of the Acoustical Society of America vol. 121, No. 6, Jun. 2007, United States, pp. 3542-3557.

Hughes et al., "Real-Time Calculation of a Limiting Form of the Renyi Entropy Applied to Detection of Subtle Changes in Scattering Architecture", Journal of the Acoustical Society of America vol. 126, No. 5, Nov. 2009, United States, pp. 2350-2358.

Hughes et al., "Sensitive Ultrasonic Detection of Dystrophic Skeletal Muscle in Patients with Duchenne Muscular Dystrophy using an Entropy-Based Signal Receiver", Ultrasound in Medicine & Biology vol. 133, No. 8, 2007, United States, pp. 1236-1243.

Hughes, "A Comparison of Shannon Entropy Versus Signal Energy for Acoustic Detection of Artificially Induced Defects in Plexiglas", Journal of the Acoustical Society of America vol. 91, No. 4, Apr. 1992, United States, pp. 2272-2275.

Hughes, "Analysis of Digitized Waveforms using Shannon Entropy", Journal of the Acoustical Society of America vol. 93, No. 2, Feb. 1993, United States, pp. 892-906.

Hughes, "Analysis of Digitized Waverforms using Shannon Entropy. II. High-Speed Algorithms Based on Green's Functions", Journal of the Acoustical Society of America vol. 95, No. 5, May 1994, United States, pp. 2582-2588.

Hughes, "Analysis of Ultrasonic Waveforms using Shannon Entropy", IEEE Ultrasonics Symposium, 1992, United States, pp. 1205-1209.

Larche et al., "A Comparison of Different NDE Signal Processing Technologies Based on Waveform Entropies Applied to Long Fiber-Graphite/Epoxy-Plates", Proceedings of SPIE vol. 10169, 2017, United States, 11 pages.

Maurizi, "Estimations of an Entropy-Based Functional", Entropy vol. 12, Mar. 3, 2010, Switzerland, pp. 338-374.

* cited by examiner (Large Room Firing From Center)
Real-Time Amplitude
Time (Seconds)
38 Revolver Power Spectrum of Event
Y(f)²/Hz
Frequency (Hz)
ALARMS (Large Room Firing From Center)
Real-Time Amplitude
Time (Seconds)
Balloon Pop Power Spectrum of Event
Y(f)²/Hz
Frequency (Hz)
REJECTS ALARMS
REJECTS
9mm Pistol
(Large Room Firing From Center)
Real-Time Amplitude
Time (Seconds)

22 Pistol
(Large Room Firing From Center)
Real-Time Amplitude
Time (Seconds)

Balloon Pop
(Large Room Firing From Center)
Real-Time Amplitude
Time (Seconds)

Snap Pops
(Large Room Firing From Center)
Real-Time Amplitude
Time (Seconds)

38 Revolver
(Large Room Firing From Center)
Real-Time Amplitude
Time (Seconds)

45 Pistol
(Large Room Firing From Center)
Real-Time Amplitude
Time (Seconds)

ALARMS
REJECTS
Paper Bag Pop
(Large Room Firing From Center)
Real-Time Amplitude
Time (Seconds)

Notebook Slap
(Large Room Firing From Center)
Real-Time Amplitude
Time (Seconds)

Shot Gun - 12 Gauge
(Large Room Firing From Center)
Real-Time Amplitude
Time (Seconds)

M4 Assault Rifle
(Large Room Firing From Center)
Real-Time Amplitude
Time (Seconds)

ALARMS
REJECTS
Whistle
(Large Room Firing From Center)
Real-Time Amplitude
Time (Seconds)

Pipe on Ladder Rung
(Large Room Firing From Center)
Real-Time Amplitude
Time (Seconds)

SYSTEM AND METHOD OF DETECTING AND ANALYZING A THREAT IN A CONFINED ENVIRONMENT

STATEMENT REGARDING FEDERALLY SPONSORED RESEARCH OR DEVELOPMENT

This invention was made with Government support under Contract DE-AC0576RLO1830 awarded by the U.S. Department of Energy. The Government has certain rights in the invention.

TECHNICAL FIELD

This invention relates to sensor systems. More specifically, this invention relates to a gunshot detection method and system which can distinguish between threats and non-threats and determine the type of weapon or weapons used, including measuring the number of rounds fired, in a confined environment.

BACKGROUND

Incidents involving active shooters which include shootings in a confined environment, such as a school or classroom, has been increasing yearly and the statistics associated with them are that "a life is lost every 15 seconds." This translates into the first responders protocol to "locate and engage" the shooter as quickly as possible. This implies that to save lives detection and location of the shooter is the most critical information for first responders.

Gunshots are significant energy events having both large audio decibel levels and long signal durations of up to half a second. Both of these attributes are enhanced by reflections from the walls and the floor, which increases the signal duration by the associated delayed arrival of the signal multi-paths. The large amounts of energy released by a weapon discharge also generate significant nonlinearities which result in the generation of higher harmonics.

Current gunshot detection systems are designed for deployment in an open-air environment, such as a street, battlefield, ocean, or wilderness region such as a rain forest. In open environment, there is infinite space, and the sound wave of a gunshot is, to first approximation, free to propagate without significant reflections from nearby boundaries. In this environment, features of the shock wave or shock front (e.g., rise time, rise slope) produced by the discharge can be analyzed.

In a confined or substantially closed environment, there are several complications when a firearm is discharged. There is the sound of the gunshot itself, sound of the bullet impacting a wall or target close to the gunshot, and reflections off the wall, ceiling, or floor. In this setting, the shock wave or shock front from the explosion moves at a certain speed and is distorted due to multiple reflections. So using the shock front in a confined space such as a room, as opposed to an open environment, would require an extremely difficult analysis that would necessitate incorporation of the complex boundary geometry particular to the room in which the weapon was discharged.

What is needed is a sensor system which can detect and analyze the gunshot in a confined environment to distinguish between threats and non-threats, determine the type(s) of weapons involved and the number of rounds fired, and doing so without requiring room-specific signal analysis.

SUMMARY

The present invention is directed to methods, systems, and devices detecting and analyzing a threat in a confined environment. In one embodiment, a system for detecting and analyzing a threat in a confined environment is disclosed. The system includes a microphone for receiving acoustic signals from the confined environment and an amplifier to increase the amplitude of the audio signals. The system also includes a first band-pass filter whose output contains energy within a first frequency range, and a second band-pass filter whose output contains energy within a second frequency range. The system further includes an analog-to-digital converter for digitizing the amplified and filtered signals to produce digital waveforms, and a microcontroller to receive and analyze the digital signals. The microcontroller computes signal energy to distinguish between a threat and a non-threat event and measure or count pulses if the event is a threat. The signal energy may be defined as, but is not limited to, the sum of the squared voltages contained in the digital signal or a portion thereof.

In one embodiment, the first frequency range is between 5 kHz and 30 kHz, and the second frequency range is between 0.9 MHz and 1.0 MHz.

The system may further comprise a transceiver coupled to the microcontroller. The transceiver transmits the signals to at least one of the following for emergency response: a computer, a mobile device, a data storage device, and a central alarm system.

The microcontroller has a central processing unit (CPU) for analyzing the signals.

The system may further comprise at least one of the following: a power source, a camera coupled to the microcontroller, and a smoke alarm module.

In one embodiment, the threat is a gunshot.

In one embodiment the confined environment may be a school house, a classroom, a public building, a shopping mall, a vehicle, a theater, a housing unit, a tavern, or a food market.

In another embodiment of the present invention, a device for detecting and analyzing a threat in a confined environment is disclosed. The device includes an audio board for detection and analysis of audio signals. The device also includes a RF board for transmitting the signals for emergency response. The device further includes a battery for providing power to the audio board and the RF board. The audio board includes a microcontroller with at least one band-pass filter for distinguishing between a threat and a non-threat event and for measuring or counting pulses if the event is a threat.

In one embodiment, the audio board further includes an amplifier to increase amplitude of the signals and an analog-to-digital converter for digitizing the amplified and filtered signals to produce digital waveforms.

In one embodiment, the audio board further includes a camera and a smoke alarm module.

The microcontroller includes a CPU for analyzing the signals, and also indicates the amount of energy in the at least one band-pass filtered signal.

In one embodiment, the energy contained in the at least one band-pass filtered signal is measured in a 5 kHz to 30 kHz frequency range and in a 0.9 MHz to 1.0 MHz frequency range. The measured signal in the 5 to 30 kHz range is used to distinguish between threat and non-threat events, and the measured signal in the 0.9 MHz to 1.0 MHz range is used to measure number of weapon discharges.

The RF board includes a transceiver for transmitting the signals to the emergency response, which may be a computer, a mobile device, a data storage device, and/or a central alarm system.

In another embodiment of the present invention, a method of detecting and analyzing a threat in a confined environment is disclosed. The method includes receiving one or more acoustic signals from the confined environment; measuring energy in a frequency range using a first band-pass filter; and measuring pulses in a time domain using a second band-pass filter.

In another embodiment of the present invention, a method of detecting and analyzing a threat in a confined environment is disclosed. The method includes receiving audio signals from the confined environment; and measuring or counting a number of zero crossings of the signals in at least one of a plurality of separate time interval windows to distinguish between a threat and a non-threat event and a type of threat.

In one embodiment, each time window is less than about 500 milliseconds.

The type of threat distinguished may be between a rifle, a shotgun, an assault rifle, a pistol, a revolver, or an explosive charge.

DETAILED DESCRIPTION OF THE PREFERRED EMBODIMENTS

The following description includes the preferred best mode of embodiments of the present invention. It will be clear from this description of the invention that the invention is not limited to these illustrated embodiments but that the invention also includes a variety of modifications and embodiments thereto. Therefore the present description should be seen as illustrative and not limiting. While the invention is susceptible of various modifications and alternative constructions, it should be understood, that there is no intention to limit the invention to the specific form disclosed, but, on the contrary, the invention is to cover all modifications, alternative constructions, and equivalents falling within the spirit and scope of the invention as defined in the claims.

The present invention includes methods, systems and devices directed to detecting and authenticating the presence of a threat in a confined environment. The threat may be, but is not limited to, an active shooter. The confined environment may be, but is not limited to, a school or classroom setting.

In one embodiment, the system of the present invention is a miniature, low cost system that would reside within school classrooms. It can be battery operated and have a wireless reporting link to a central alarm system for emergency '911' response.

The present invention can distinguish normal classroom events from gun shots. The present invention is designed for confined environments, has a very low item cost, is simple to install, and also provides exact shooter location.

The present invention uses the time-domain and/or frequency domain for signal analysis to separate gunshot from normal expected classroom or other confined environment sounds. Signal filtering may be implemented both in hardware such as, but not limited to, microphone baffles and analog filtering, and in firmware such as, but not limited to, digital band-pass filtering.

In one embodiment, the present invention utilizes energy analysis that combines to amplitude and signal duration.

Systems, devices, and methods of the present invention can also count the number of shots fired as a confirmation on the basis that repetitive signals have features that can only come from a weapon. In another embodiment, the present invention can determine the type of weapon or weapons used.

In contrast to the high energy gun shot signatures, normal classroom audio events have considerably lower amplitude decibel levels in addition to much shorter signal durations. In one embodiment, a detection threshold is used that must be exceeded before any analysis will occur. This will be a power saving feature and will also self-reject normal classroom audio activity.

Figure 1:
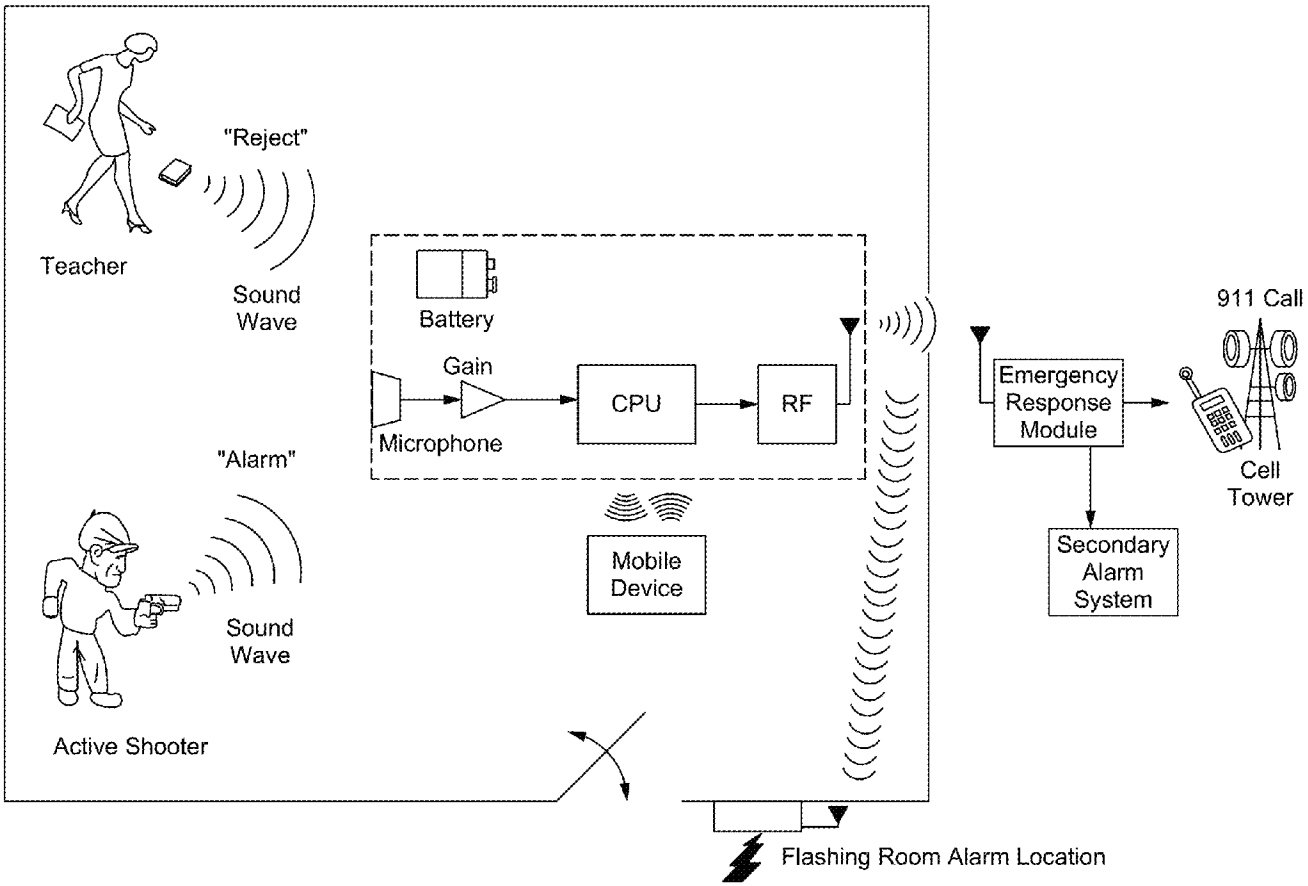
FIG. 1 is a schematic diagram of a system for detecting and analyzing a threat in a confined environment, in accordance with one embodiment of the present invention.

FIG. 1 is a schematic diagram of a system for detecting and analyzing a threat in a confined environment, in accordance with one embodiment of the present invention. The system is designed to sound an alarm when the sound waves are from an active shooter and reject (no alarm) when the sound waves are normal classroom events such as the sound made from a book dropped by a teacher or the slamming of a door.

Still referring to FIG. 1, the system includes a microphone for receiving acoustic signals from the confined environment, an amplifier to increase amplitude of the audio signals, a microcontroller including a central processing unit (CPU) for analyzing the signals, a power source or battery, and a transceiver, coupled to the CPU, for transmitting the signals to one or more of the following for emergency response: a mobile device or tablet, a central or local alarm system or module, and/or a data storage device or reader. The emergency response module may be coupled to a cell tower and/or a secondary alarm system such as a computer, reader or storage device.

The system includes one or more filters whose output contains energy within a certain frequency range. In one embodiment, the system includes a first band-pass filter whose output contains energy within a frequency range between approximately 5 kHz and approximately 30 kHz, and a second band-pass filter whose output contains energy within a frequency range between approximately 0.9 MHz and 1.0 MHz.

Figure 2:
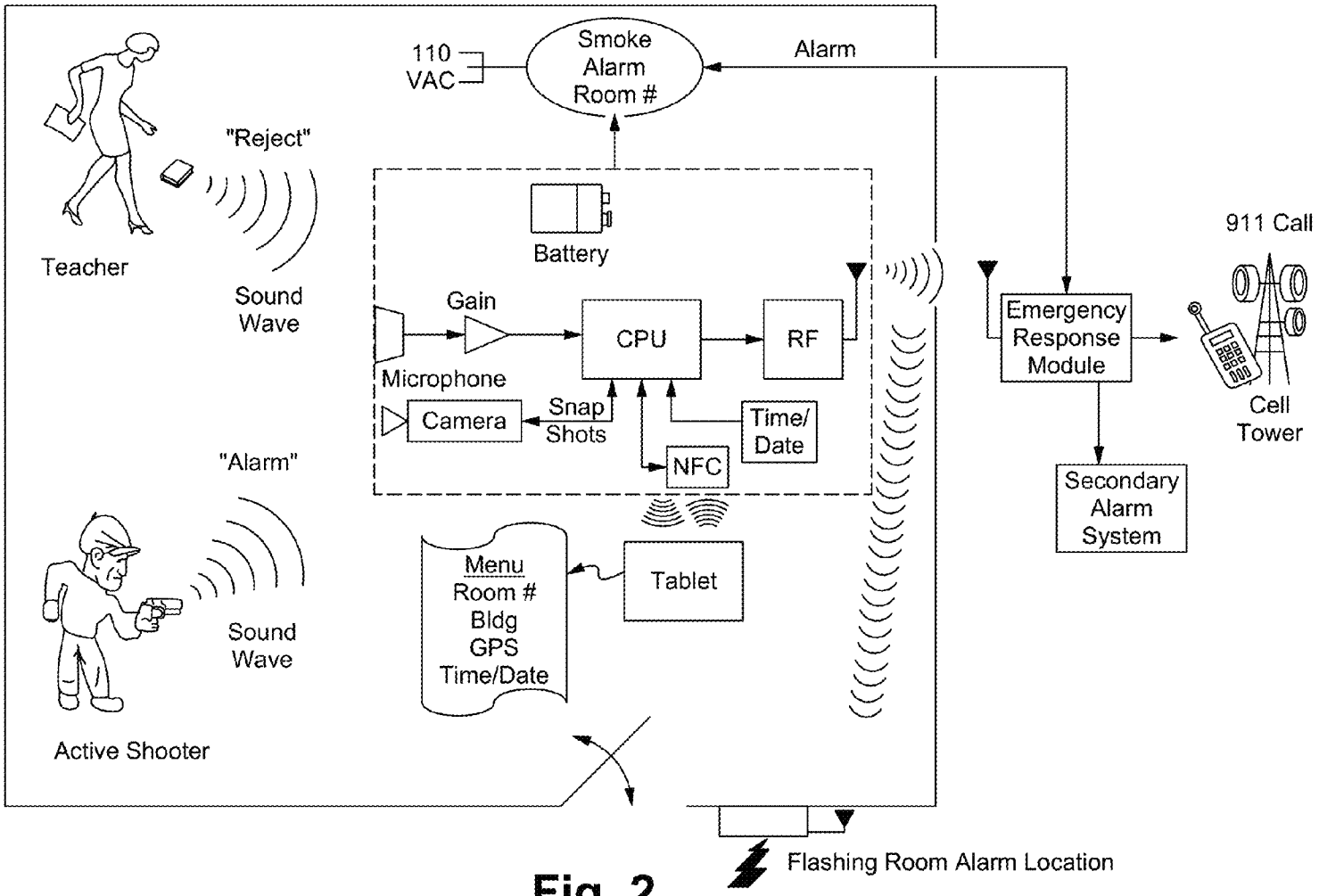
FIG. 2 is a schematic diagram of a system for detecting and analyzing a threat in a confined environment, in accordance with one embodiment of the present invention.

FIG. 2 is a schematic diagram of a system for detecting and analyzing a threat in a confined environment, similar to FIG. 1, in accordance with one embodiment of the present invention. In addition to the embodiment as shown in FIG. 1, the embodiment of FIG. 2 further includes a camera coupled to the CPU, a smoke alarm module coupled to a 110 VAC power source, which can be feed into the emergency response module, near field communications (NFC) technology to enable communications between the CPU and a mobile device such as a tablet. The tablet can include a menu that displays, for example, the room or classroom number, building, GPS, and local time and date. The system can also include data and time hardware coupled to the CPU for keeping track of dates and times of any threats.

Figure 3:
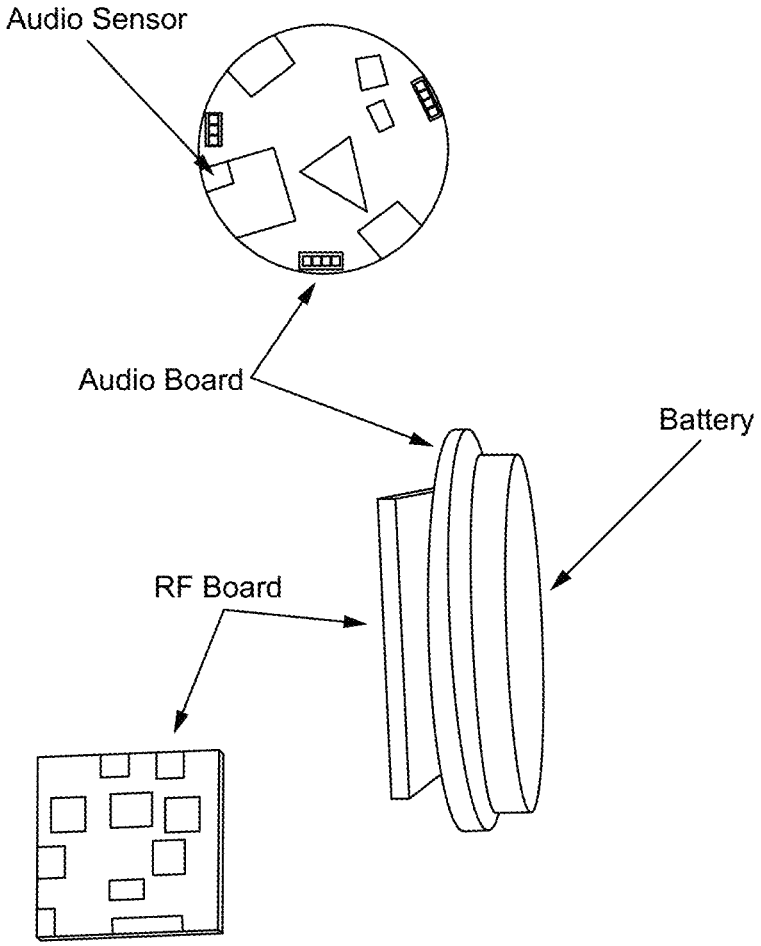
FIG. 3 is a diagram of a device for detecting and analyzing a threat in a confined environment, in accordance with one embodiment of the present invention.

FIG. 3 is a diagram of a device for detecting and analyzing a threat in a confined environment, in accordance with one embodiment of the present invention. The device includes an audio board for detection and analysis of audio signals, a RF board for transmitting the signals for emergency response, and a battery for providing power to the audio board and the RF board. The audio board includes at least one band-pass filter for distinguishing between a threat and a non-threat and for measuring or counting pulses if the event is a threat.

In one embodiment, the device of FIG. 3 comprises two printed circuits—the audio and RF boards—and a battery. The battery can be, but is not limited to, a coin cell battery. The audio board includes a microphone for detection of audio sounds. The microphone may be a cellphone microphone. An audio decibel level activated trigger instigates digitization of the audio signal by an on-board microcontroller. The digitized signal is analyzed by algorithms to determine if the audio signal is from a weapon or threat for alarm indication. If an alarm is triggered, a data packet is sent from the audio board to the RF board for wireless transmission to an emergency alarm module located inside or outside of the room. The transmitted wireless packet would consist of information deemed valuable to a first responder, such as room location, room number, time-stamp, and associated weapon attributes including weapon type and number of rounds fired. System setup for room specifics can be loaded via a wireless link or NFC from a mobile device such as a tablet or smart phone. In one embodiment, the device can be hidden, housed, or installed in an innocuous device, for example, a real or fake smoke detector or an LED light bulb, which would provide power to the device. In that case, the battery of the device would be optional.

Figure 4:
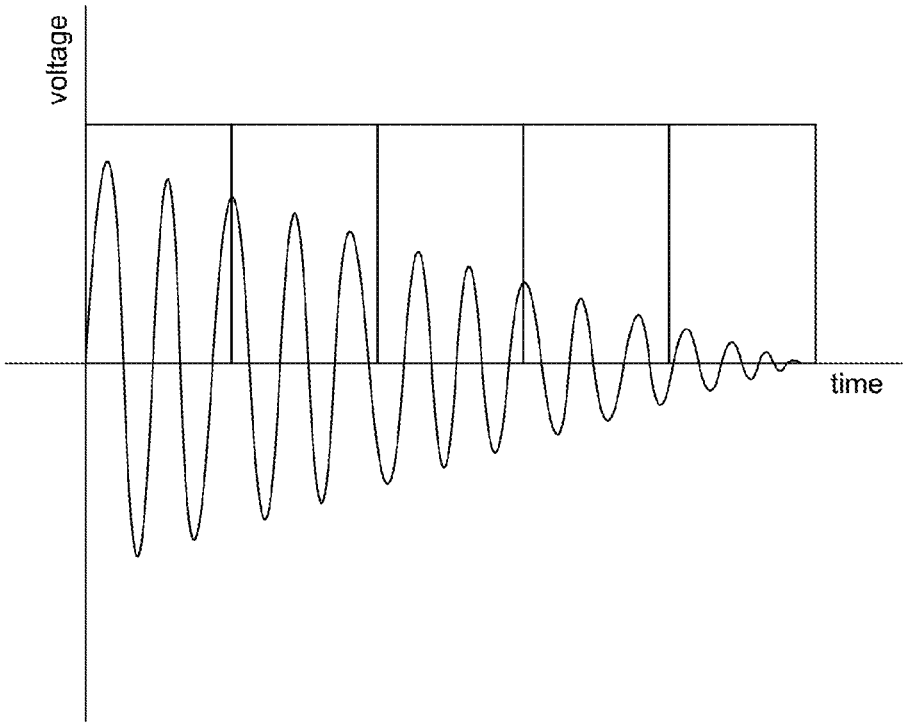
FIG. 4 depicts a measuring technique performed by the method of detecting and analyzing a threat in a confined environment, in accordance with one embodiment of the present invention.

FIG. 4 depicts a measuring technique performed by the method of detecting and analyzing a threat in a confined environment, in accordance with one embodiment of the present invention. Audio signals are received from a confined environment. The number of zero crossings of the signals are measured or counted in a plurality of separate time interval windows to distinguish between a threat and a non-threat event, including the type of threat.

In one embodiment, each time window is less than about 500 milliseconds.

The type of threat distinguished may be between a rifle, shotgun, assault rifle, pistol, revolver, and/or an explosive charge.

EXPERIMENTAL SECTION

The following examples serve to illustrate embodiments and aspects of the present invention and should not be construed as limiting the scope thereof.

Example 1

Acquisition of Data Signatures

Three data collections sessions were acquired from the Hanford Patrols Shoot House, which is a facility in Richland, Wash., used for training purposes. It consists of a matrix of adjoining rooms but without a ceiling. There is a catwalk in place of the ceiling for instructor evaluation of training exercises. The walls are steel-lined to allow for live shooting into "traps".

Two sessions at the Shoot House involved personnel firing preselected weapons. The shooters fired long barrels (shotguns), pistols (22, 9 mm, and 45), a revolver (38) and an assault rifle (M4, which is a shortened version of a M16).

Another session consisted of acquiring audio signatures from classroom events that have some of the similar features as a weapon such as large decibel levels (balloon pop) and long durations (whistle).

Two sensing systems using the cellphone microphones were used at fixed ceiling height locations with firing positions at six different room locations. The three sessions—two for firing the weapons and one for the classroom noises—resulted in 15 gigabytes of data for post analysis.

Figure 5:
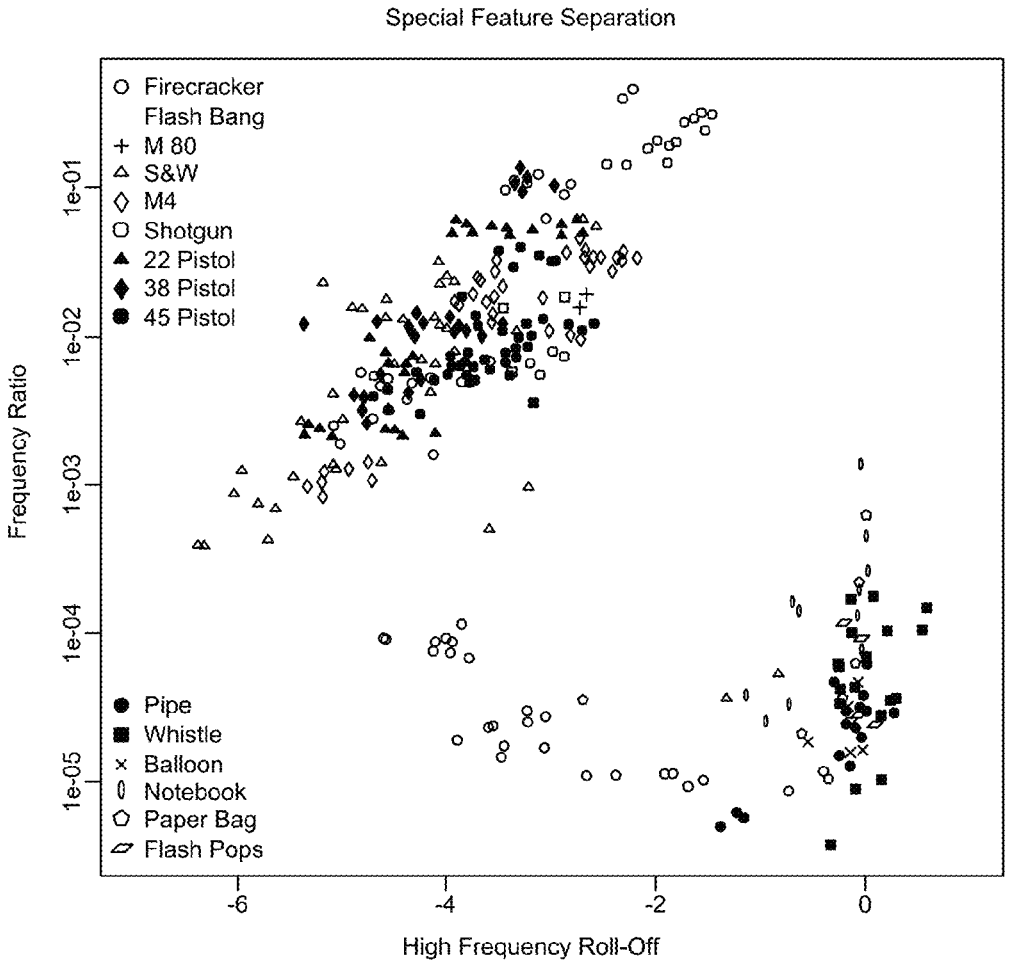
FIG. 5 provides a visualization of the frequency ratios of gun shots or threats on the top left of the spectrum and other classroom noise or non-threats on the bottom right of the spectrum, and included in the data is the high frequency roll-off of the measurements.
Figure 6:
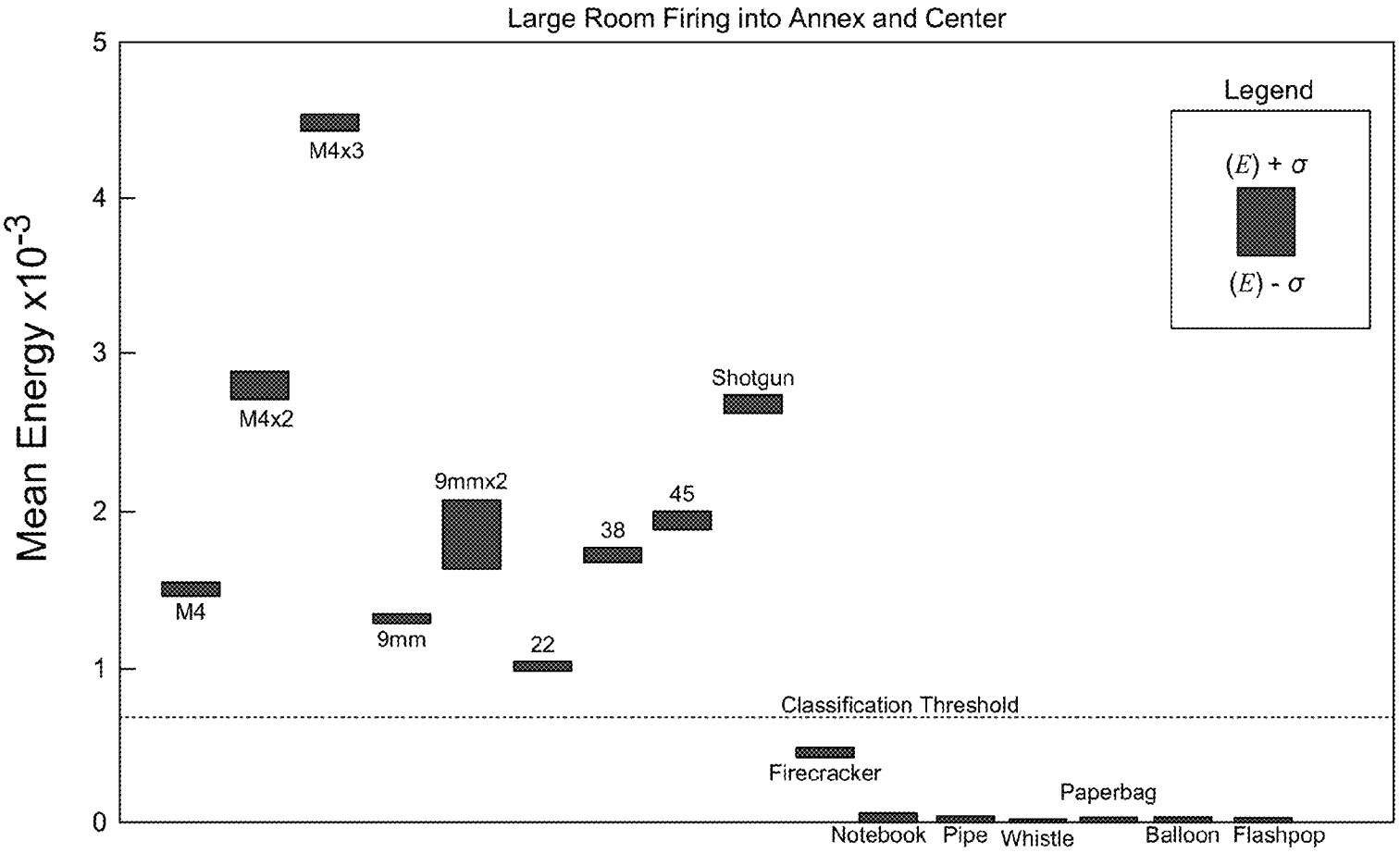
FIG. 6 provides a visualization of the mean energies from various types of guns or threats and other noises or non-threats, acquired in large rooms and shooting centers. If the signal energy is above the classification threshold then the event is classified as a threat.
Figures 7A, 7B, 7C, 7D:
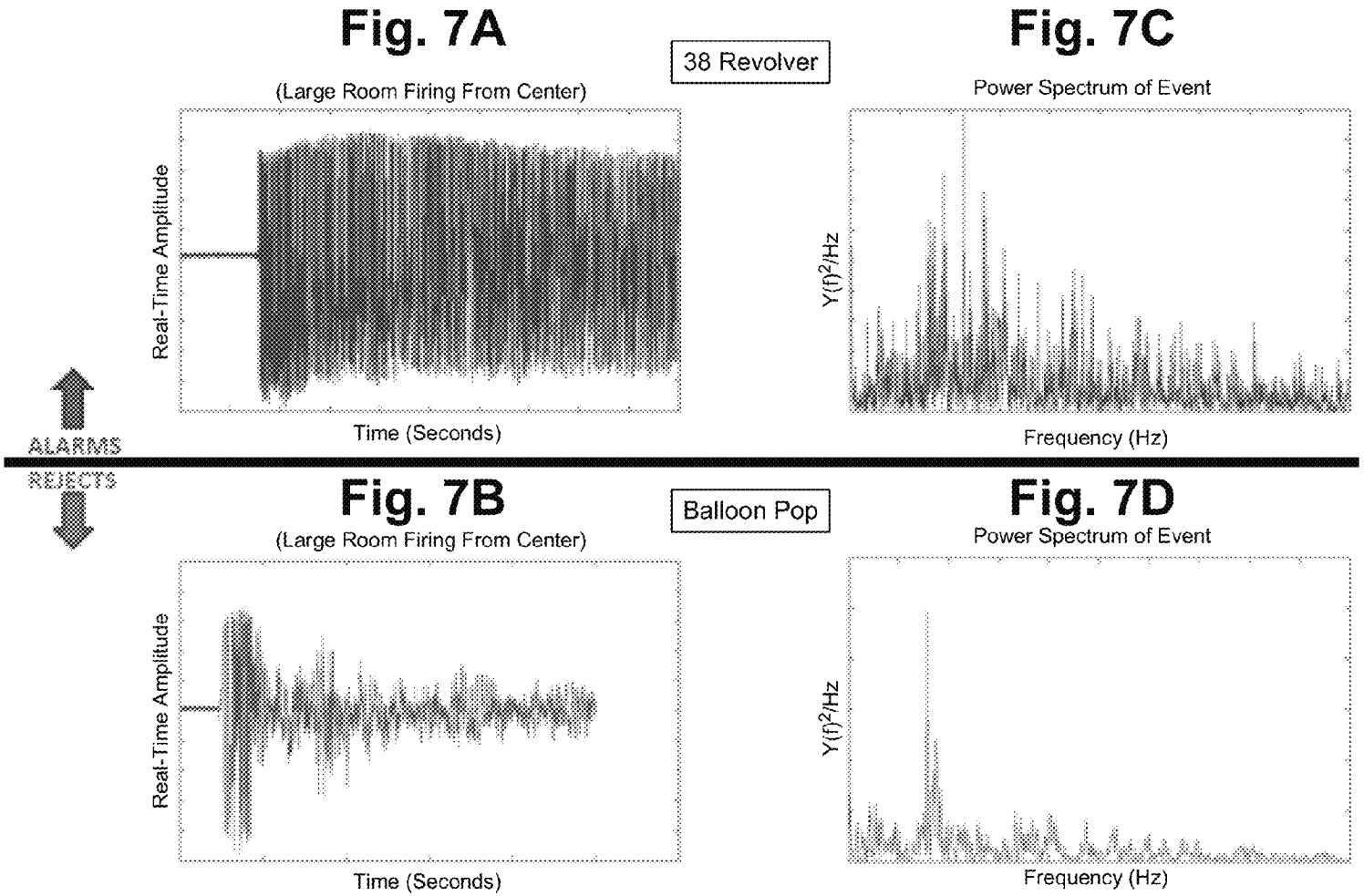
FIGS. 7A-D shows the acoustic waveforms in real-time amplitude vs. time (FIGS. 7A and 7B) and power spectral density in the frequency domain (FIGS. 7C and 7D) for a weapon alarm event (38 revolver) and for a classroom reject event (balloon pop).

FIGS. 5 and 6 show summary graphs depicting robustness in separating shots from classroom events. FIG. 5 provides a visualization of the frequency ratios of gun shots or threats on the top left of the spectrum and other classroom noise or non-threats on the bottom right of the spectrum, and included in the data is the high frequency roll-off of the measurements. This data analysis method utilizes signal frequency content.

FIG. 6 provides a visualization of the mean energies from various types of guns or threats and other noises or non-threats, acquired in large rooms and shooting centers. If the mean energy is above the classification threshold then the event is classified as a threat. This data analysis method utilizes signal energy content.

FIGS. 7A-D shows the acoustic waveforms in real-time amplitude vs. time (FIGS. 7A and 7B) and power spectral density in the frequency domain (FIGS. 7C and 7D) for a weapon alarm event (38 revolver) and for a classroom reject event (balloon pop). The data was collected from the Shoot House, as described above, and analyzed using the analysis methods of the present invention in the time domain and the frequency domain. Both the time domain and frequency domain methods indicated success in separating gunshots from normal expected classroom noises.

As compared to the classroom sounds, the gunshots exhibited larger audio decibels within certain frequency ranges and had longer signal durations.

Figures 8A, 8B, 8C, 8D:
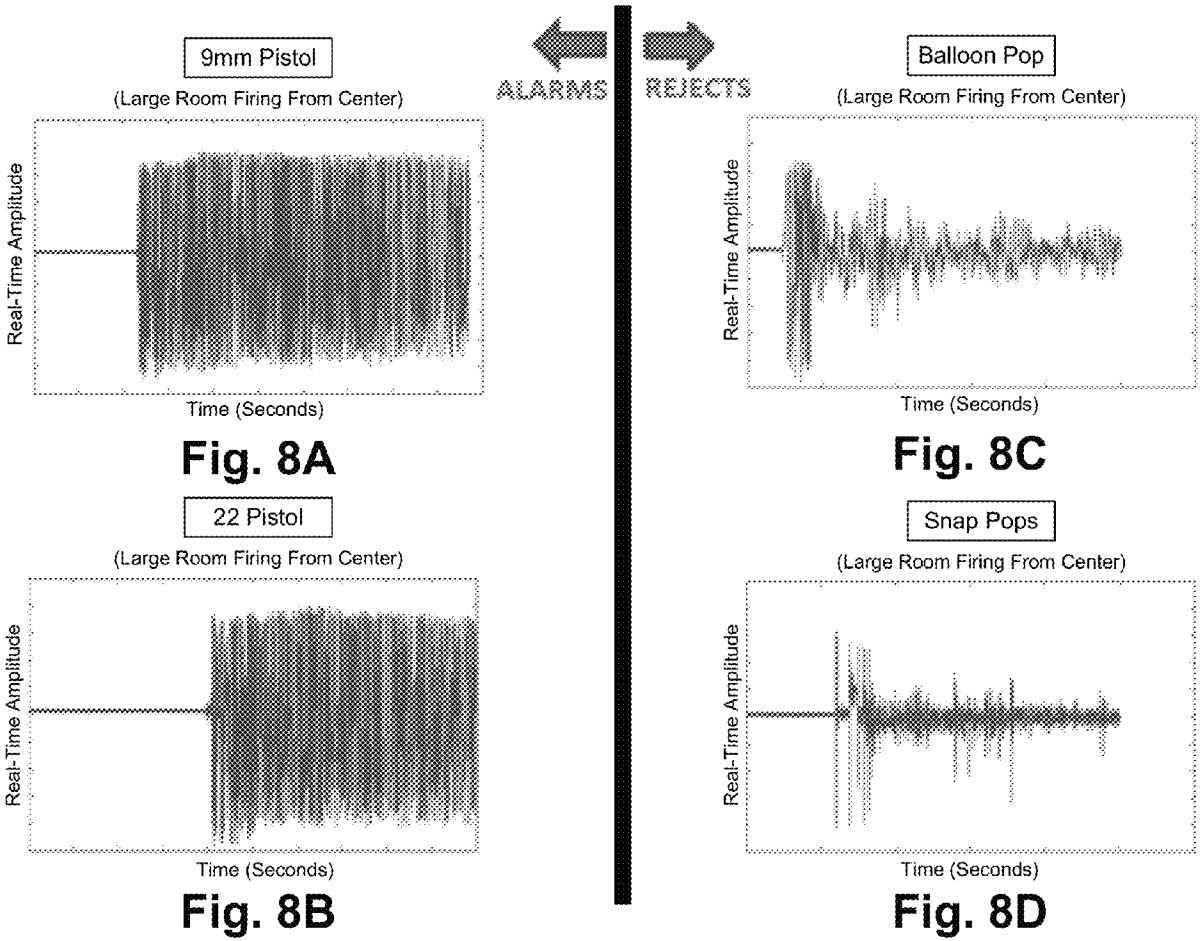
FIGS. 8A-D shows the acoustic waveforms in real-time amplitude vs. time for weapon alarm events FIG. 8A (9 mm pistol) and FIG. 8B (22 pistol) and for classroom reject events FIG. 8C (balloon pop) and FIG. 8D (snap pop).

FIGS. 8A-D shows the acoustic waveforms in real-time amplitude vs. time for weapon alarm events FIG. 8A (9 mm pistol) and FIG. 8B (22 pistol) and for classroom reject events FIG. 8C (balloon pop) and FIG. 8D (snap pop). The data was collected from the Shoot House, as described above, and analyzed using the analysis methods of the present invention in the time domain. In this example, the signal energy was analyzed in the time domain using the methods of the present invention. Signal analysis in the time domain was able to distinguish threats from non-threat and the type of weapon used for the threat. The signal energy profiles are different for a 9 mm pistol as compared to a 22 pistol.

Figures 9A, 9B, 9C, 9D:
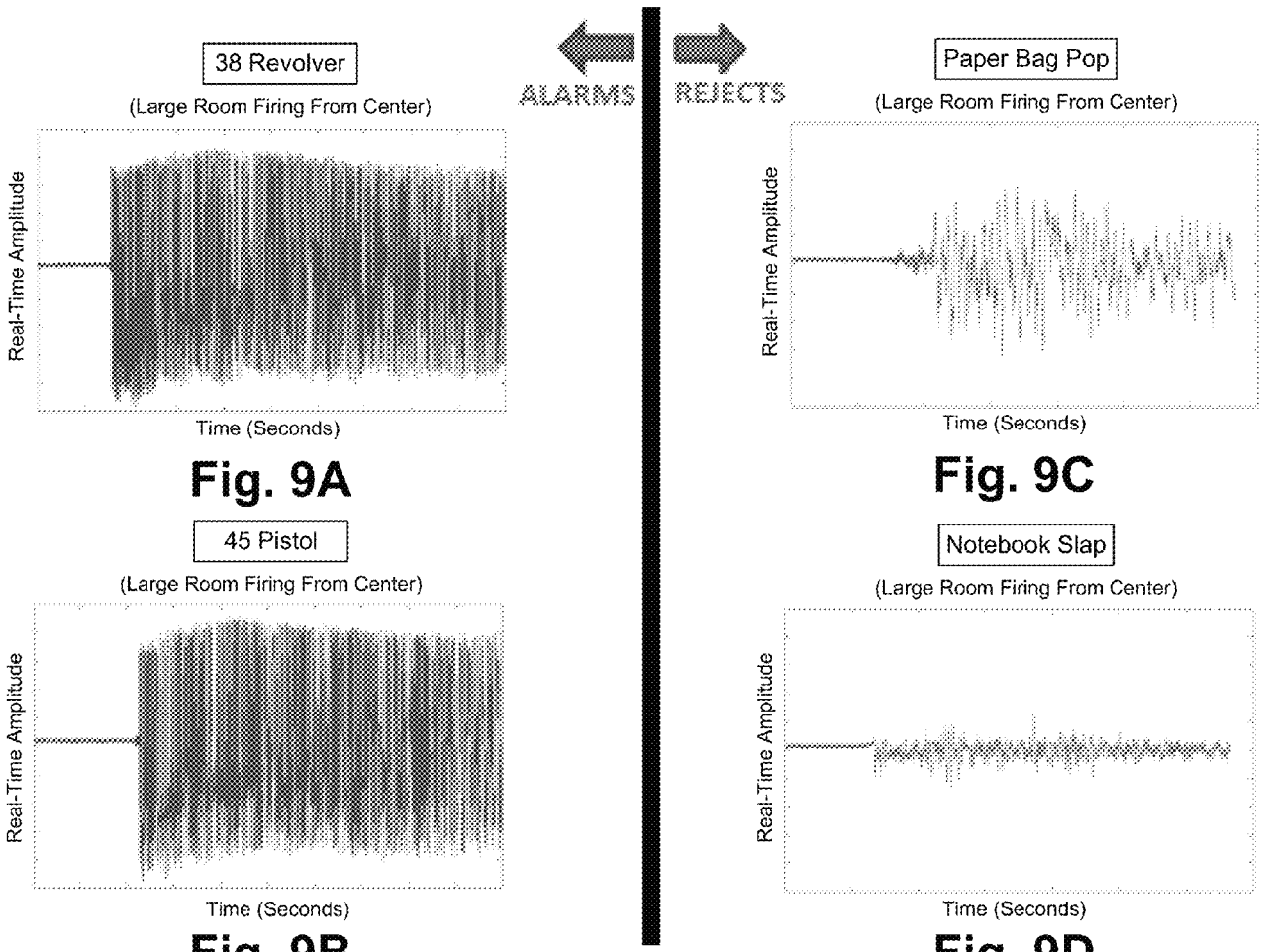
FIGS. 9A-D shows the acoustic waveforms in real-time amplitude vs. time for weapon alarm events FIG. 9A (38 revolver) and FIG. 9B (45 pistol) and for classroom reject events FIG. 9C (paper bag pop) and FIG. 9D (notebook slap).

FIGS. 9A-D shows the acoustic waveforms in real-time amplitude vs. time for weapon alarm events FIG. 9A (38 revolver) and FIG. 9B (45 pistol) and for classroom reject events FIG. 9C (paper bag pop) and FIG. 9D (notebook slap). The data was collected from the Shoot House, as described above, and analyzed using the analysis methods of the present invention in the time domain. In this example, the signal energy was analyzed in the time domain using the methods of the present invention. Signal analysis in the time domain was able to distinguish threats from non-threat and the type of weapon used for the threat. The signal energy profiles are different for a 38 revolver as compared to a 45 pistol.

Figures 10A, 10B, 10C, 10D:
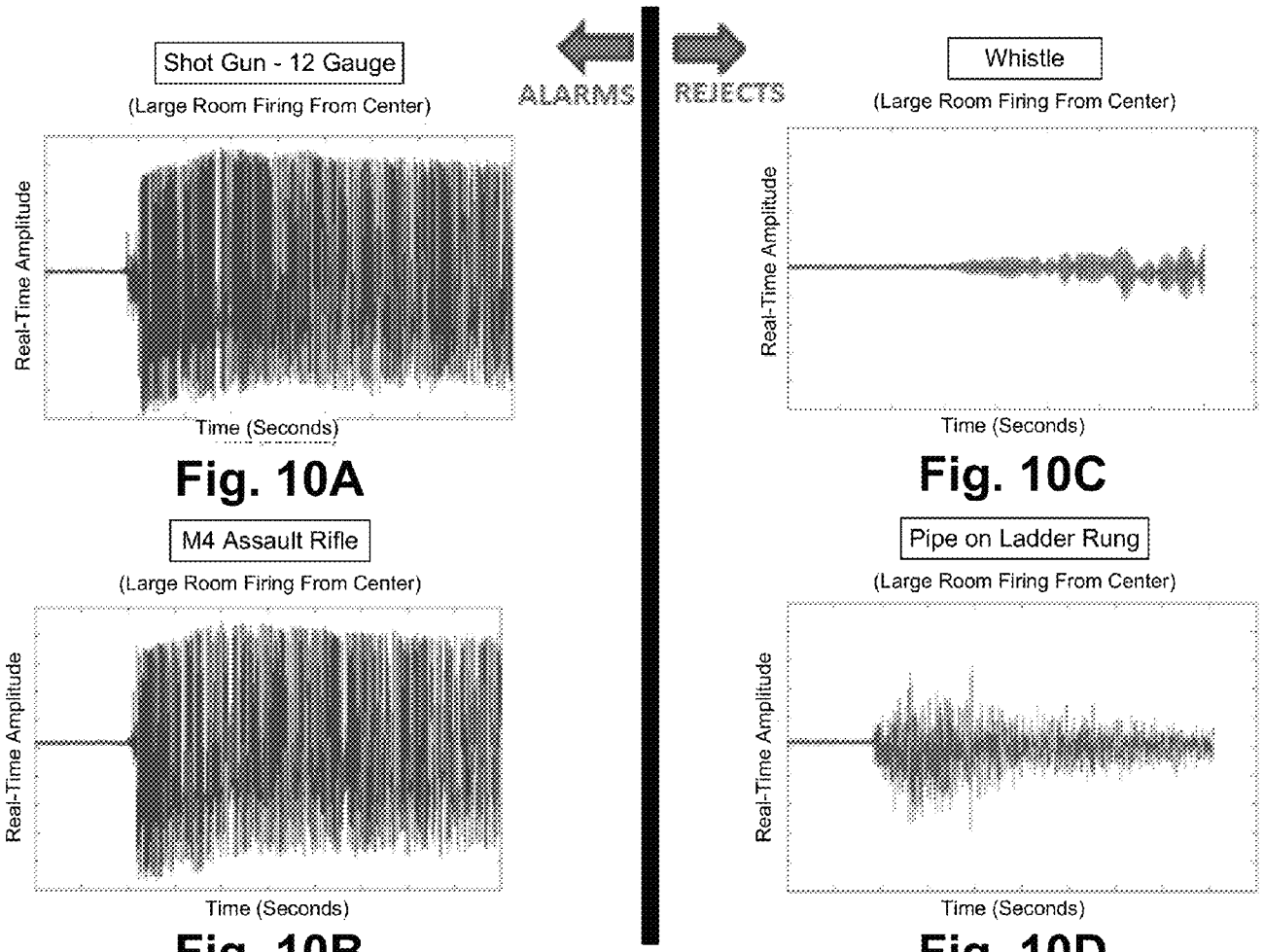
FIGS. 10A-D shows the acoustic waveforms in real-time amplitude vs. time for weapon alarm events FIG. 10A (shot gun—12 Gauge) and FIG. 10B (M4 Assault Rifle) and for classroom reject events FIG. 10C (whistle) and FIG. 10D (pipe on ladder rung).

FIGS. 10A-D shows the acoustic waveforms in real-time amplitude vs. time for weapon alarm events FIG. 10A (shot gun—12 Gauge) and FIG. 10B (M4 Assault Rifle) and for classroom reject events FIG. 10C (paper bag pop) and FIG. 10D (notebook slap). The data was collected from the Shoot House, as described above, and analyzed using the analysis methods of the present invention in the time domain. Signal analysis in the time domain was able to distinguish threats from non-threat and the type of weapon used for the threat. The signal energy profiles are different for a 12 Gauge shot gun as compared to a M4 Assault Rifle.

Example 2

Shot Detection System Firmware Flow

The following processing steps provide validation for the analysis method described above and with reference to FIG. 4. The analysis method was embedded into the microcontroller and validated with live fire testing. Seven 112 ms windows were used to obtain both variance and zero-crossing counts for each individual window that were all combined into an "Adjusted Variance". The "Adjusted Variance" was used for comparison the "Alarm/Reject" threshold, described above, yielding a "classification" for the event. The validation steps are as follows:

Step 1: Wait acoustic "Event Detection" interrupt

Step 2: Start zero-crossing counter—repeatedly used to obtain individual zero-crossing counts for seven 112 ms (milliseconds) windows Step 3: Digitize 16K points @ 7 microseconds/point=112 ms (8-bit resolution)

Step 4: Read & clear zero-crossing counter (Count #0)

Step 5: Digitize 16K points @ 7 us/point=112 ms (8-bit resolution)

Step 6: Read & clear zero-crossing counter (Count #1)

Step 7: Start zero-crossing counter, wait 112 ms, read and clear (Count #2)

Step 8: Repeat step #7 four more times (Count #3-6)

Step 9: Calculate energy variance on step #3 waveform (Variance #0)

Step 10: Calculate energy variance on step #5 waveform (Variance #1)

Step 11: Ratio counts for Count #1 and #2 and use the ratio multiplied by Variance #1 to become Variance #2

Step 12: Repeat step #11 for ratio of each sequential Count# with Count #1 and Variance #1 for new variance (Variances 3-6)

Step 13: Add seven Variances 0-6 for "Adjusted Variance"

Step 14: Compare "Adjusted Variance" to preset "Alarm Threshold"

Step 15: If event is an "Alarm" then archive the 32K waveform points along with the variances, count values & timestamp Step 16: Initiate RF transfer of the "Alarm" event Step 17: Return to Step #1

While a number of embodiments of the present invention have been shown and described, it will be apparent to those skilled in the art that many changes and modifications may be made without departing from the invention in its broader aspects. The appended claims, therefore, are intended to cover all such changes and modifications as they fall within the true spirit and scope of the invention.

We claim:

1. A system for detecting and analyzing a threat in a confined environment comprising:

a microphone for receiving acoustic signals from the confined environment and generating electrical signals which correspond to the received acoustic signals;

conversion circuitry configured to receive the electrical signals and to generate digital signals comprising digital data which corresponds to the received acoustic signals;

a microcontroller configured to receive the digital signals and to use the digital signals to compute signal energy to distinguish between a threat event and a non-threat event; and wherein the microcontroller is configured to compute a sum of squared voltages in the digital signals to compute the signal energy.

2. The system of claim 1 further comprising a transceiver, coupled to the microcontroller, for transmitting information regarding the threat event to a remote device for emergency response.

3. The system of claim 1 wherein the microcontroller has a central processing unit (CPU) for analyzing the digital signals.

4. The system of claim 1 further comprising a power source, a camera coupled to the microcontroller, and a smoke alarm module.

5. The system of claim 1 wherein the threat is a gunshot and the confined environment is at least one of the following: a school house, a classroom, a public building, a vehicle, a shopping mall, a theater, a housing unit, a tavern, and a food market.

6. The system of claim 1 further comprising:

an amplifier configured to increase amplitude of the electrical signals and to output amplified signals;

a first band-pass filter configured to receive the amplified signals and output filtered signals in a first frequency range;

a second band-pass filter configured to receive the amplified signals and output filtered signals in a second frequency range; and an analog-to-digital converter configured to digitize the filtered signals in the first and second frequency ranges to produce the digital signals.

7. The system of claim 6 wherein the first frequency range is between 5 kHz and 30 kHz, and the second frequency range is between 0.9 MHz and 1.0 MHz.

8. The system of claim 1 wherein the microcontroller is configured to count a number of pulses if the threat event is detected.

9. The system of claim 1 wherein the microcontroller is configured to compare the computed signal energy with a threshold to distinguish between the threat event and the non-threat event.

10. The system of claim 9 wherein the microcontroller is configured to determine the presence of the threat event if the computed signal energy is greater than the threshold.

11. The system of claim 1 further comprising a band-pass filter configured to only pass the electrical signals within a defined frequency range.

12. The system of claim 1 wherein the microcontroller is configured to analyze the digital signals in the time domain to compute the signal energy.

13. A method of detecting and analyzing a threat in a confined environment comprising:

receiving one or more acoustic signals from the confined environment;

generating one or more electrical signals which correspond to the received one or more acoustic signals;

digitizing the one or more electrical signals to generate one or more digital signals comprising digital data which corresponds to the received one or more acoustic signals;

processing the one or more digital signals to compute signal energy to distinguish between a threat event and a non-threat event; and wherein the processing comprises computing a sum of squared voltages in the one or more digital signals to compute the signal energy.

14. The method of claim 13 wherein the one or more electrical signals are filtered to contain frequencies in a 5 kHz to 30 kHz frequency range and the one or more electrical signals are filtered to contain frequencies in a 0.9 MHz to 1.0 MHz frequency range.

15. The method of claim 13 further comprising transmitting information regarding the threat event to a remote device for emergency responses.

16. The method of claim 13 further comprising counting a number of pulses if the threat event is detected.

17. The method of claim 13 further comprising comparing the computed signal energy with a threshold to distinguish between the threat event and the non-threat event.

18. The method of claim 17 determining the presence of the threat event if the computed signal energy is greater than the threshold.

19. The method of claim 13 further comprising band-pass filtering the one or more electrical signals within a defined frequency range before the digitizing.

20. The method of claim 13 wherein the processing comprises processing the one or more digital signals in the time domain to compute the signal energy.

21. A system for detecting and analyzing a threat in a confined environment comprising:

a. a microphone for receiving acoustic signals from the confined environment;

b. a microcontroller with at least one band-pass filter to use a plurality of digital signals which correspond to the received acoustic signals to compute signal energy for distinguishing between a threat event and a non-threat event;

c. a transceiver for transmitting information regarding the threat event to a remote device for emergency response; and wherein the microcontroller is configured to compute a sum of squared voltages in the digital signals to compute the signal energy.

* * * * *